United States Patent [19]

Beuyukian et al.

[11] 4,212,690

[45] Jul. 15, 1980

[54] HEAT TREAT FIXTURE AND METHOD OF HEAT TREATING

[76] Inventors: Robert A. Frosch, Administrator of the National Aeronautics and Space Administration, with respect to an invention of Charles S. Beuyukian, Gardena, Calif.; Robert M. Heisman, Palos Verdes Peninsula, Calif.; Cyrus C. Haynie, Newport Beach, Calif.; Emil P. Ruppe, La Crescenta, Calif.

[21] Appl. No.: 23,501

[22] Filed: Mar. 23, 1979

[51] Int. Cl.[2] ..... C22F 1/04

[52] U.S. Cl. ..... 148/131; 266/119; 266/249; 266/274

[58] Field of Search ..... 266/249, 117, 119, 274; 148/131

[56] References Cited

U.S. PATENT DOCUMENTS 3,534,947 10/1970 Lenz ..... 266/117

*Primary Examiner*—R. Dean

*Attorney, Agent, or Firm*—Howard J. Osborn; John R. Manning

[57] ABSTRACT

A heat treating fixture is disclosed in which the shape of the metal specimen is maintained by cold rolled steel support plates. Glide sheets of stainless steel, coated with boron nitride, in contact with each face of the metal specimens, allow for lateral expansion of the metal specimens without binding. Grooved support bars separate the glide sheets from the upper and lower support plates and allow flow of quenching fluid to the metal specimen.

9 Claims, 1 Drawing Figure

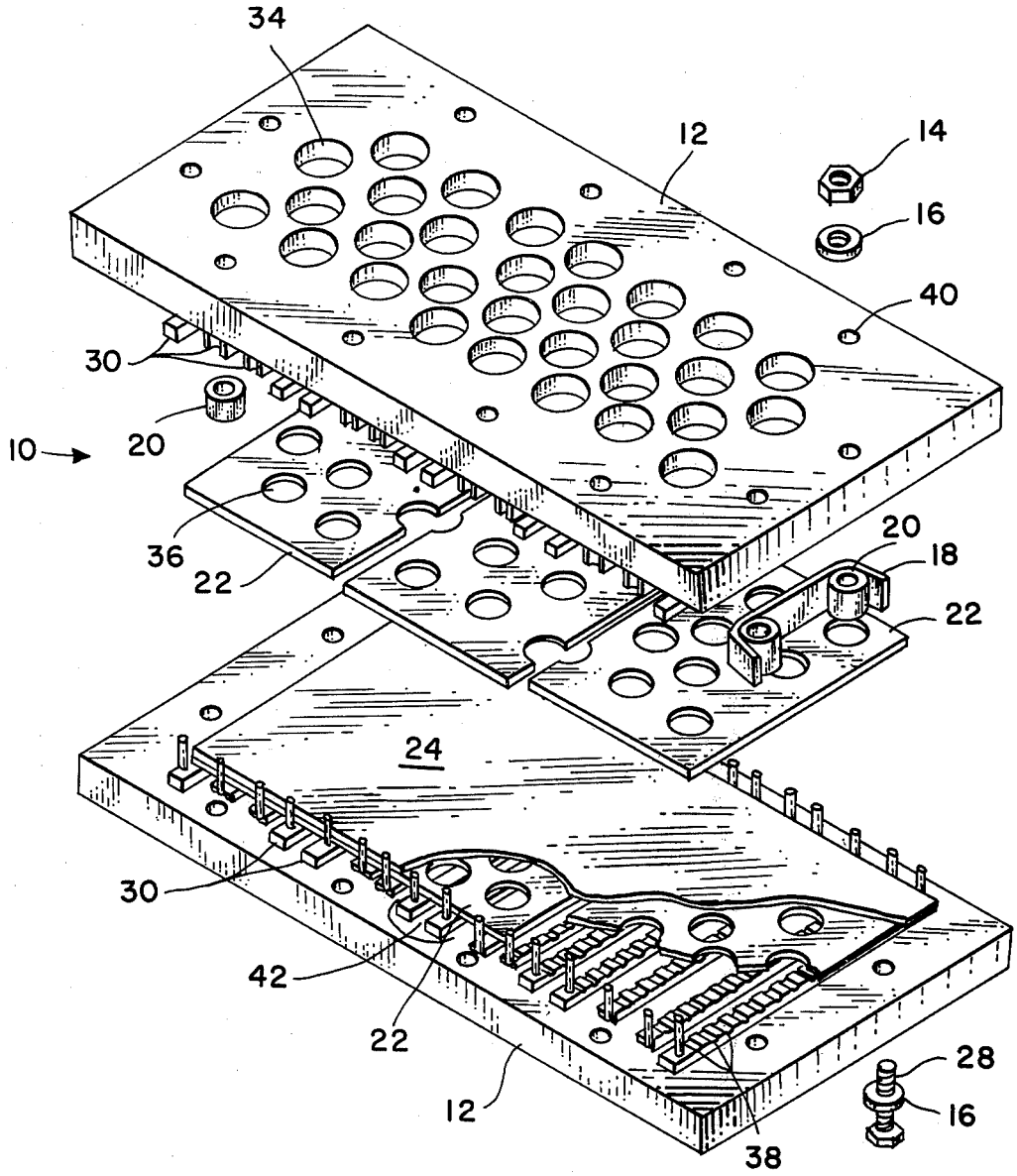
34
12
14
16
40
30
20
10
36
22
20
18
22
24
30
42
22
12
28
16
38

HEAT TREAT FIXTURE AND METHOD OF HEAT TREATING

ORIGIN OF THE INVENTION

The invention described herein was made in the performance of work under a NASA contract and is subject to the provisions of Section 305 of the National Aeronautics and Space Act of 1958, Public Law 85-586 (72 Stat. 435; 42 USC 2457).

BACKGROUND OF THE INVENTION

This invention relates to a heat treating fixture, with spacers to prevent excessive clamping pressure, and glide sheets to allow lateral expansion of the metal specimen to be heat treated.

DESCRIPTION OF THE PRIOR ART

Heat treating metal is known to increase the metal's hardness and strength. The heat treating process involves raising the metal to a specific temperature and holding the metal at that temperature for a period of time. The temperature of the metal is then rapidly reduced, usually by quenching in a fluid bath, to some predetermined temperature range. Unequal heating or unequal cooling of the metal could cause the metal specimen being heat treated to expand or contract at different rates over its length, causing the specimen to warp. The warping could be so extensive as to render the metal specimen unusable.

Prior art discloses methods of clamping the metal to be heat treated between metal plates or in a die. This method of heat treating does reduce the amount the metal specimen warps, but with the metal specimen clamped tightly in place, the metal specimen is unable to expand laterally during heating and quenching. This restriction on lateral expansion in itself introduces a certain amount of stress on the metal specimen which causes warping of the metal specimen.

It is therefore an object of the present invention to provide a heat treating fixture which will clamp the metal specimen firmly in place to prevent warping, but allow lateral expansion and contraction as the metal specimen is heated and cooled.

SUMMARY OF THE INVENTION

According to the present invention, the foregoing and other objects are attained by providing a heat treating fixture wherein the metal specimen to be heat treated is sandwiched between an upper and lower support plate. The metal specimen is supported by support bars on the inside faces of both the upper support plate and the lower support plate. The metal specimen is separated from the support bars by glide sheets which allow the metal specimen to expand and contract laterally during heating and quenching.

Spacer bushings around the edge of and between the upper and lower support plates maintain the proper spacing between the support plates. The upper and lower support plates are clamped together with nuts and bolts.

The upper and lower support plates and the glide sheets have one and one-half inch holes to allow flow of the quenching fluid.

BRIEF DESCRIPTION OF THE DRAWING

A more complete appreciation of the invention and many of the attendent advantages thereof will be readily apparent by reference to the following detailed description when considered in connection with the accompanying drawing wherein:

FIG. 1 is a perspective partially in section of a heat treating fixture according to the present invention.

DESCRIPTION OF THE PREFERRED EMBODIMENT

Referring now more particularly to FIG. 1, there is illustrated a preferred embodiment of the present invention as it would be used in a heat treating fixture, designated generally by reference numeral 10. The metal specimen 24 to be heat treated is sandwiched between glide sheets 22. Glide sheets 22 are separated from support plates 12 by support bars 30. Support plates 12 are clamped together by bolts 28 and nuts 14.

The metal specimen 24 to be heat treated in the preferred embodiment is an actively cooled, aluminum alloy panel of the type used on actively cooled, hypersonic aircraft surfaces. It is to be understood; however, that the invention has application to a specimen constructed of any metal or alloy. Previously used clamp type heat treating fixtures did not permit sliding of the metal specimen to compensate for thermal expansion and the resulting metal specimen was often more than 0.090 inches out of flat. The part was often able to be straightened, but straightening was time consuming and expensive even when possible.

The present invention uses glide sheets 22 to prevent sticking or binding of the metal specimen as it expands and contracts during heating or quenching. The glide sheets 22 in the preferred embodiment are stainless steel and coated with boron nitride. The boron nitride is used as a lubricant. It may be applied as a spray or painted on with a brush and retains its lubricating properties up to and beyond 2000° F. It functions to prevent galling and binding of the specimen to the glide sheets. The glide sheets 22 have one and one-half inch diameter holes, spaced so that the centers are approximately two and one-half inches apart. The specific dimensions are for purposes of illustration only, it is to be understood many variations would be apparent to those skilled in the art.

Support bars 30, laid width wise, separate the glide sheets 22 and the support plates 12. In the preferred embodiment the support bars 30 are spaced approximately one inch apart. The spaces 42 between the support bars 30, and the grooves 38 in the support bars 30, improve the flow of quenching fluid to the metal specimen 24. In the preferred embodiment the support bars are aluminum alloy because the metal specimen 24 is aluminum alloy. In general, the support bars 30 should be of the same material as metal specimen 24 to permit relatively constant clamping pressure during heating and cooling. The support bars 30 are maintained in position by support bar pins 26. It should be understood that if the specimen is of a different metal or alloy, the support bars would be made of the same material as the specimen.

Excessive clamping pressure would prevent the metal specimen 24 from sliding as it expanded even with the use of glide sheets 22. To prevent excessive clamping pressure, spacers 20 and end spacers 18 are used to maintain a precise distance between support plates 12. The spacers 20 and end spacers 18 maintain the distance between support plates 12 such that the support plates 12 clamp the metal specimen 24 firmly, but not so firmly that binding results as heating and quenching occur.

Spacers 20 and end spacers 18 should be of the same material as metal specimen 24 to permit relatively constant clamping pressure during heating and cooling.

The support plates 12 are cold rolled steel, three quarters inch thick. One and one-half inch diameter holes 34 are drilled in the support plates 12 to allow free flow of the quenching fluid. The holes 34 are spaced approximately two and one-half inches apart, center to center.

The support plates 12 are clamped together by use of bolts 28, washers 16 and nuts 14. Bolts 28 and nuts 14 are steel in the preferred embodiment. The clamping pressure used in the preferred embodiment is approximately one to two foot-pounds.

In actual use of the heat treating fixture 10, the metal specimen 24, and heat treating fixture 10, were heated to 995±10° F. (Farenheit) and held at that temperature for 60–70 minutes. The heat treating fixture 10, with metal specimen 24, was then quenched in water. Distortion of the metal specimen 24 was approximately 0.030 inches, and the metal specimen 24 was easily straightened.

It will be understood that the foregoing description is of the preferred embodiment of the invention and is therefore merely representative. Obviously, there are many variations and modifications of the present invention in light of the above teachings that will be readily apparent to those skilled in the art. It is therefore understood that within the scope of the appended claims the invention may be practiced otherwise than as specifically described.

What is claimed as new and desired to be secured by Letters Patent of the United States is:

1. A heat treating fixture for maintaining the shape of a metal specimen during heat treating and quenching comprising:

an upper and lower support plate;

support bars on the inner faces of said upper and lower support plates;

upper and lower glide sheets, one between the support bars associated with each of said support plates and the said metal specimen, separating the test specimen from said support bars and allowing expansion of the test specimen;

spacers between said support plates and at the edge of said support plate to prevent excessive clamping pressure; and clamping means for maintaining said upper and lower support plates, said support bars, said glide sheets, and the metal specimen in close contact.

2. A heat treating fixture as in claim 1 wherein said clamping means consists of nuts, bolts, and washers, said bolts passing through said upper and lower support plates and spaced around the perimeter of said upper and lower support plates.

3. A heat treating fixture as in claim 1 wherein said glide sheets are stainless steel coated with boron nitride.

4. A heat treating fixture as in claim 1 wherein said upper and lower support plates are cold rolled steel.

5. A heat treating fixture as in claim 1 wherein said spacers and said support bars are of the same material as the metal specimens to be heat treated.

6. A heat treating fixture as in claim 1 wherein said support bars are grooved to permit flow of quenching fluid to the metal specimen.

7. A heat treating fixture as in claim 1 wherein said upper and lower support plates have apertures at spaced intervals to permit flow of quenching fluid to the metal specimen.

8. A heat treating fixture as in claim 1 wherein said glide sheets have apertures at spaced intervals to permit flow of quenching fluid to the metal specimen.

9. A method of heat treating a metal specimen comprising the steps of:

(1) placing the metal specimen between two glide sheets which allow the metal specimen to expand during heat treating without binding;

(2) placing support bars on the outer surfaces of said glide sheets to allow passage of quenching fluid;

(3) placing support plates on the outer faces of said support bars to prevent the metal specimen from warping;

(4) placing spacers between said support plates at their outer edge to limit clamping pressure on the metal specimen;

(5) placing nuts and bolts and washers around the outer edge of said support plates so that the bolts pass through said support plates and are tightened to provide clamping pressure on the metal plates;

(6) heating the assembly comprised of the metal specimen and heat treating fixture to such temperature as appropriate for tempering the specimen;

(7) maintaining the specimen and fixture at elevated temperature for a period of time;

(8) quenching the specimen and fixture in a fluid bath at a predetermined temperature; and (9) removing the bolts from the support plates, and the support plates and glide sheets from the specimen.

* * * * *